United States Patent [19]

Haynes

[11] 4,084,273

[45] Apr. 18, 1978

[54] REVOLVABLE ROCKABLE PLAYPEN

[76] Inventor: Elwood W. Haynes, 6303 Pizzaro St., Duluth, Minn. 55807

[21] Appl. No.: 705,705

[22] Filed: Jul. 15, 1976

Related U.S. Application Data

[63] Continuation of Ser. No. 589,474, Jun. 23, 1975, abandoned.

[51] Int. Cl.[2] ..... A47D 9/02; A47D 9/04; A63G 1/00

[52] U.S. Cl. ..... 5/105; 5/108; 272/33 A; 297/258

[58] Field of Search ..... 5/105, 108; 297/72, 297/258, 272; 272/28; 220/68, 69, 70

[56] References Cited

U.S. PATENT DOCUMENTS

| | | | |
|---|---|---|---|
| 595,139 | 12/1897 | Blakely | 5/105 |
| 697,627 | 4/1902 | Johns et al. | 220/68 |
| 1,057,555 | 4/1913 | Jones | 220/70 |
| 2,049,539 | 8/1936 | Greenwood | 297/258 |
| 2,343,470 | 3/1944 | Nast | 220/68 |
| 2,988,358 | 6/1961 | Mills | 5/105 |

*Primary Examiner*—Paul R. Gilliam
*Assistant Examiner*—Victor N. Sakran
*Attorney, Agent, or Firm*—Wicks & Nemer

[57] ABSTRACT

A revolvable playpen including a hollow body having an open upper end and a bottom. The bottom of the body has an annular extension substantially normal to the wall of the hollow body and secured to the lower under surface of the bottom is a semi-spherical member. The annular extension limits the degree of tilt of the playpen so that an infant within the playpen can safely revolve the pen about the annular extension and rock upon the semi-spherical member without tipping over.

1 Claim, 6 Drawing Figures

REVOLVABLE ROCKABLE PLAYPEN

CROSS REFERENCE

This is a continuation of application Ser. No. 589,474, filed June 23, 1975, now abandoned.

SUMMARY

The invention relates to an improvement in playpens for infants and more particularly to a playpen that is revolvable and also rockable. It is an object of the invention to provide a playpen having a hollow body in which an infant can sit. The bottom of the body has a semi-spherical rocker member attached thereto and an annular flange at the bottom which limits the angle of the tip of the hollow body while resting on the semi-spherical member.

In the drawings forming part of this application:

Figure 1:
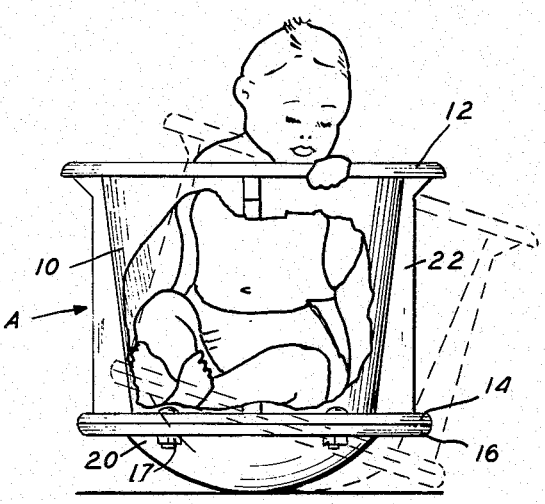
FIG. 1 is an elevational view of a revolvable combination seat and playpen embodying the invention a portion of which is broken away with a child illustrated as sitting within the device, the limit of tilting being shown in broken lines.
Figure 2:
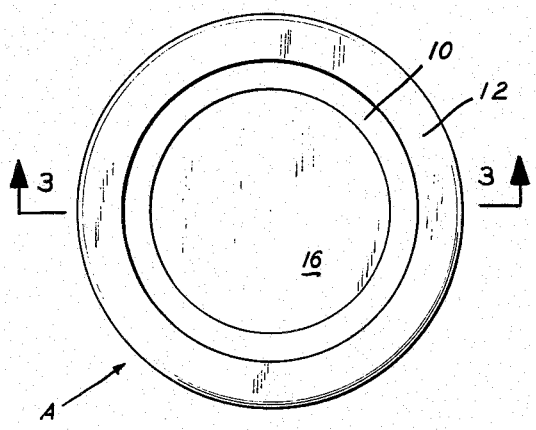
FIG. 2 is a top plan view of the combination seat and playpen.
Figure 3:
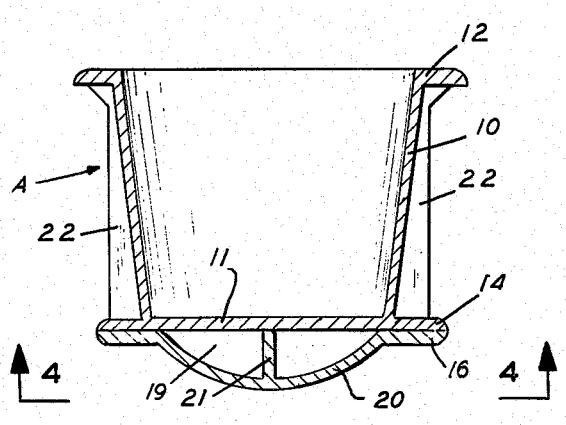
FIG. 3 is a sectional view on the line 3—3 of FIG. 2.

Referring to the drawings in detail, the revolvable combination seat and playpen A includes the hollow walled body portion 10 frusto-conical in form with the bottom 11 at the smaller diameter as the lower end. Connected to the upper end of the body 10 and extending outwardly therefrom at substantially a right angle is the upper annular flange 12 which provides a gripping means for the infant using the device. The numeral 14 designates a lower annular flange which is connected to and extends outwardly from the lower end of the body at substantially a right angle and parallely disposed to the flange 12.

Further provided is the circular bottom 16 which is secured to the annular flange 14 by means of the nut-equipped bolts 17 and it is coextensive with the flange 14. The outer portion of the bottom 16 together with the flange 14 form a single flange on the bottom end of the body 10. Formed on the underside of the bottom 16 is the semi-spherical rocker portion 20. The portion 20 is reenforced by the internal cross-members 19 and 21 which may be secured to or molded integrally with the portion 20 when the bottom 16 is made of plastic. Further provided are the elongated vertical supports 22 which are secured at the inner edges thereof to the wall of the body 10 and at the upper end to the underside of the flange 12 with the lower end secured to the upper surface of the flange 14. The supports 22 may be secured by glue, bolts, screws, or the like or the supports may be molded integrally with a plastic body 10.

The volumetric size of the body 10 is such that an infant up to about two years of age may be placed within the body 10 as illustrated in FIG. 1 and the device may be tilted upon the rocker portion 20 and revolved about the edge of the flange 16 portion somewhat as illustrated in FIG. 1 in broken lines. The extent of the flange determines the degree of tilt and rock of the device. The device confines the infant and allows it to rock to a limited degree and revolve to the infant's delight and amusement.

Figure 5:
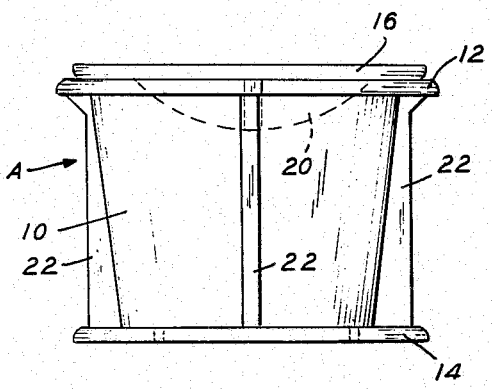
FIG. 5 is an elevational view of the seat and playpen with the bottom member removed and placed partially within the top of the playpen.
Figure 6:
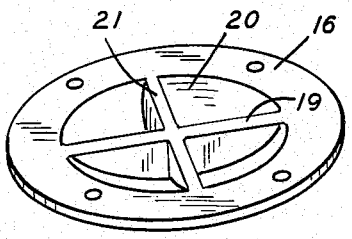
FIG. 6 is a perspective view of the bottom member removed from the device.
Figure 4:
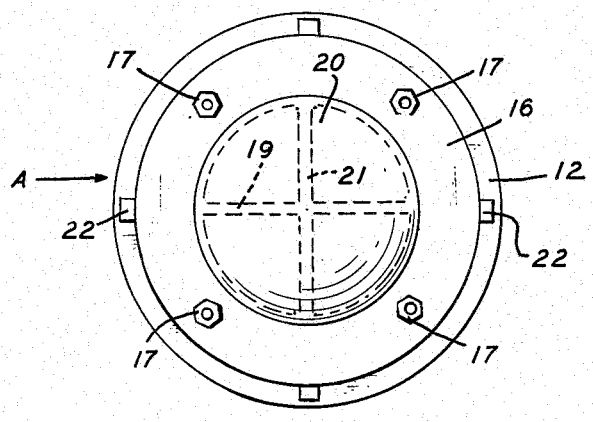
FIG. 4 is a view on the line 4—4 of FIG. 3.

In storage and shipment of the device A the bottom member may be removed, reversed and positioned upon the top of the body with the rocker portion positioned within the open upper end of the body 10, particularly as illustrated in FIG. 5.

Having thus described the invention, what is claimed as new and desired to be secured by Letters Patent is:

1. A revolvable rockable playpen comprising:

a. a hollow continuous frusto-conical body having the smaller diameter end positioned lowermost and an open upper end, and b. a circular bottom secured to the other end, c. a first flat annular flange formed on the lower edge of said hollow body extending outwardly therefrom and coextensive with said bottom, d. a flat circular bottom member directly connected to and substantially coextensive with said annular flange, e. said flat circular bottom member having a semi-spherical rocker portion formed directly on said circular bottom, the outer edge of which is spaced radially inwardly from the outer edge of said circular bottom, f. means connecting said circular bottom to said annular flange, and g. a second flat annular flange formed on the upper edge of said hollow body member extending outwardly therefrom substantially at a right angle and of a diameter substantially equal to the diameter of said annular flange and said circular bottom member, and h. spaced elongated flat supports extending between and connected to said first and second annular flanges.

* * * * *